US012345411B2

(12) United States Patent
Pollari

(10) Patent No.: US 12,345,411 B2
(45) Date of Patent: Jul. 1, 2025

(54) ARRANGEMENT FOR A METHOD OF SUPPORTING A SIDE WALL OF A VERTICAL FLUE GAS PASS IN A THERMAL POWER STEAM GENERATOR

(71) Applicant: SUMITOMO SHI FW ENERGIA OY, Espoo (FI)

(72) Inventor: Jussi Pollari, Kuopio (FI)

(73) Assignee: Sumitomo SHI FW Energia Oy, Espoo (FI)

( * ) Notice: Subject to any disclaimer, the term of this patent is extended or adjusted under 35 U.S.C. 154(b) by 278 days.

(21) Appl. No.: 17/925,887

(22) PCT Filed: Jun. 8, 2020

(86) PCT No.: PCT/EP2020/065821
§ 371 (c)(1),
(2) Date: Nov. 17, 2022

(87) PCT Pub. No.: WO2021/249615
PCT Pub. Date: Dec. 16, 2021

(65) Prior Publication Data

US 2023/0092056 A1 Mar. 23, 2023

(51) Int. Cl.
*F22B 37/20* (2006.01)

(52) U.S. Cl.
CPC ..... *F22B 37/203* (2013.01); *F22B 37/204* (2013.01)

(58) Field of Classification Search
CPC .... F22B 37/203; F22B 37/204; F22B 37/645; F22B 37/244; F22B 37/108; F22B 37/20; F22B 37/201
See application file for complete search history.

(56) References Cited

U.S. PATENT DOCUMENTS 3,055,349 A * 9/1962 Hamilton ..... F22B 37/203 122/510
3,814,063 A 6/1974 Bijmholt
(Continued)

FOREIGN PATENT DOCUMENTS

CN 101627258 A 1/2010
EP 143432 A * 6/1985 ..... F22B 37/203
(Continued)

OTHER PUBLICATIONS

Japanese Office Action issued Dec. 25, 2023, in corresponding Japanese Patent Application No. 2022-560220, with English translation (11 pages).
(Continued)

*Primary Examiner* — Gregory A Wilson
(74) *Attorney, Agent, or Firm* — Venable LLP

(57) ABSTRACT

An arrangement for and a method of horizontally supporting a side wall of a top-supported flue gas pass. The side wall includes evaporative water tubes at a first temperature, and the flue gas pass includes a superheating tube at a temperature higher than the first temperature and having rigid, horizontal tube legs extending across the flue gas pass between the side wall and a second side wall of the flue gas pass and being supported from above by a hanger, which is in operation at a temperature higher than the first temperature. Rigidity of the side wall is increased by horizontally supporting the side wall by the horizontal tube legs including end sections attached to the side walls by attaching means allowing relative movements of the end sections with respect to the side wall to which the end section is attached, only in a direction of their relative thermal movement.

13 Claims, 7 Drawing Sheets

(56) References Cited

U.S. PATENT DOCUMENTS

| | | | | | |
|---|---|---|---|---|---|
| 3,850,149 | A * | 11/1974 | Piaskowski | F22B 37/20 | 122/494 |
| 3,927,646 | A * | 12/1975 | Dungey | F22B 29/062 | 122/6 A |
| 5,329,892 | A * | 7/1994 | Svendsen | F22B 31/003 | 122/4 D |
| 5,762,032 | A * | 6/1998 | Patel | F22B 37/208 | 122/511 |
| 6,321,691 | B1 * | 11/2001 | Harth, III | F22B 37/203 | 165/81 |
| 8,333,170 | B2 * | 12/2012 | Zaman | F22B 37/208 | 122/511 |
| 8,393,304 | B2 | 3/2013 | Lankinen | | |

FOREIGN PATENT DOCUMENTS

| | | | | |
|---|---|---|---|---|
| FR | 2557281 | A | | 6/1985 |
| GB | 837994 | A | * | 6/1960 |
| GB | 892639 | A | | 3/1962 |
| GB | 1015838 | A | | 1/1966 |
| JP | S45-027681 | U | | 10/1970 |
| JP | H03-128204 | U | | 12/1991 |
| JP | 2006-342991 | A | | 12/2006 |
| JP | 2015-058496 | A | | 3/2015 |
| RU | 2129234 | C1 | | 4/1999 |
| WO | 2129234 | A1 | | 6/2004 |

OTHER PUBLICATIONS

European Decision to Grant issued Feb. 8, 2024, in corresponding European Patent Application No. 20733545.6 (2 pages).

Japanese Decision to Grant issued Jul. 23, 2024, in corresponding Japanese Patent Application No. 2022-560220, with English translation (6 pages).

Korean Notice of Grounds for Rejection issued Aug. 21, 2024, in corresponding Korean Patent Application No. 10-2022-7038908, with English translation (12 pages).

International Search Report and Written Opinion of the ISA for PCT/EP2020/065821, dated Feb. 10, 2021 (11 pages).

International Preliminary Report on Patentability for PCT/EP2020/065821, dated Apr. 22, 2022 (45 pages).

Decision to Grant and Search Report issued Jun. 22, 2023, in corresponding Russian Patent Application No. 2022132972 (with English translations)(24 pages).

Australian Examination Report issued Jul. 14, 2023, in corresponding Australian Patent Application No. 2020452705 (3 pages).

Chinese Office Action issued Mar. 29, 2025, in corresponding Chinese Application No. 202080101668.9, with English translation (16 pages).

Korean Decision to Grant issued Apr. 25, 2025, in corresponding Korean Application No. 10-2022-7038908, with English translation (5 pages).

* cited by examiner

ARRANGEMENT FOR A METHOD OF SUPPORTING A SIDE WALL OF A VERTICAL FLUE GAS PASS IN A THERMAL POWER STEAM GENERATOR

BACKGROUND OF THE INVENTION

Field of the Invention

The present invention relates to an arrangement for and a method of horizontally supporting a first side wall of a top-supported vertical flue gas pass in a thermal power steam. According to some advantageous embodiments of the present invention, the first side wall is a common wall of two adjacent flue gas passes in a thermal power steam generator.

Description of Related Art

Thermal power steam generators, such as circulating fluidized bed boilers, generally comprise a furnace and a flue gas duct in gas flow connection with an upper portion of the furnace. Side walls enclosing the furnace and the flue gas duct are conventionally formed as a so-called tube-wall construction comprising parallel water tubes welded together with plate-like fins. The side walls usually comprise evaporative water tubes, which in operation convey a mixture of water and steam, whereby the side walls are substantially at the evaporation temperature. The flue gas duct generally comprises multiple substantially straight sections, so-called flue gas passes. The furnace, in which flue gases are formed and conveyed mainly upwards, is often called the first flue gas pass. Usually at least one of the flue gas passes comprises a superheating tube, i.e., a steam conveying tube that is used for recovering heat from the flue gas in order to convert the steam into superheated steam at a relatively high temperature.

Patent document GB837994A mentions a way of suspending a bank of sinuous superheater tubes in a flue gas pass by supporting the superheater tubes from opposing wall tubes of the flue gas pass by fitting a pair of outwardly projecting lugs on each of the sinuous tubes and supporting the lugs on similar inwardly extending lugs welded to the wall tubes, wherein the engaging surfaces of the lugs are adapted to permit expansion and contraction of the superheater tubes with a change in temperature. The document GB837994A also discloses a way of supporting corresponding superheater tubes within a flue gas pass by support lugs attached to the return bends of the tubes and arranged to rest in sliding contact with a horizontal section of a fluid-cooled tube mounted along the inner side of opposed rows of upright fluid-cooled tubes suspended from above to lie along opposed walls of the flue gas pass.

Patent document GB892639 mentions that horizontal fluid heaters in a gas pass, such as superheaters and economizers formed from platens of nested return bend tubes disposed between opposite upright wall tubes defining a gas pass, have usually comprised brackets attached to the wall and lugs attached to the heater, wherein the platens were end supported by resting the lugs on the wall brackets, and any movement due to thermal expansion of a platen was accommodated by a relative sliding movement between the lug and a wall bracket. The document GB892639 also discloses a tubulous superheater in a gas pass of a boiler, the superheater including an upright tube platen comprising nested, sinuous tubes with tube legs horizontally extending across the gas pass, wherein the outermost return bend of nested return bends is fixed relatively to a boundary of the gas pass whilst each tube including an inner return bend is supported from the tube including the outer return bend so as to allow relative longitudinal movement between the tube legs. The lowermost tube leg of the platen may be supported from below by support means comprising upright fluid cooled support tubes that may be connected to the fluid circulation of the boiler.

U.S. Pat. No. 6,321,691 B1 discloses superheating tubes fastened to a boiler wall by brackets that are at a distance from the wall support tube and therefore do not practically increase rigidity of the wall, and any possible movement is horizontal as the bracket is perpendicular to the wall support tube.

French patent document 2 557 281 A1 discloses a device for supporting a panel of small diameter tubes, forming horizontal loops superimposed between vertical walls of a large enclosure. A lower part of the panel comprises in its lower zone a certain number of tubes secured to each other by means of fins welded to the tubes, to form a rigid structure. This structure thus constitutes a load bearing beam that rests on the front and rear vertical walls of the flue. The coupling provides a substantially immovable joint between the tube bundle and the vertical tubes in horizontal direction.

Vertical tube-walled side walls of a furnace and of other flue gas passes in a thermal power steam generator are usually supported against pressure differences between the inside and the outside of the side walls by multiple strong beams, so-called buckstays, arranged hanging on outer surfaces of the side walls. Such buckstays increase the weight and costs of the construction. U.S. Pat. No. 8,393,304 B2 discloses supporting vertical tube-walls enclosing a top-supported furnace of a boiler in a way that enables reducing the weight of the buckstays by connecting the walls to vertical ground-supported pillars, wherein the connecting is performed such that motion of the water-tube walls is possible only in the directions caused by motions due to temperature changes of the boiler. Finding new ways for being able to further minimize the weight or number of buckstays needed to support the side walls of a boiler would naturally be desirable.

Some steam generators comprise a vertical flue gas pass with a superheating tube having a common wall with an adjacent earlier i.e., an upstream flue gas pass. As an example, a so-called over-the-top configuration of a fluidized bed boiler may have a vertical flue gas pass having a common wall with the furnace. As another example, a fluidized bed boiler, such as a waste firing boiler, may have an empty pass having a common wall with a downstream flue gas pass with a superheating tube. Because there is an intense flow of hot flue gas flow on both sides of such a common wall, the common wall generally cannot be strengthened by conventional buckstays.

GB1015838 discloses a steam generator in which a combustion chamber and an adjacent flue gas pass, having a common wall with the combustion chamber, are stiffened by horizontal ring frames encircling both the combustion chamber and the gas pass. The common tube wall of the combustion chamber and the gas pass is stiffened by cooled horizontal struts arranged along the common wall, which horizontal struts are reinforced by cooled, transverse horizontal struts arranged across the gas pass.

Pressure differences that may prevail over a common wall of the furnace of a circulating fluidized bed boiler and an adjacent back pass may typically be relatively large, such as 6000 Pa, or even more. In order to economically form a common wall, i.e., an internal wall in a boiler construction that can sustain such pressure differences, there is a need to develop a new arrangement for and a new method of supporting such a common wall. Pressure gradients that may in operation occur over a common wall of an empty pass arranged between a furnace and a downstream flue gas pass and the downstream flue gas pass are typically relatively small, such as of the order of 100 Pa. However, in case the width and/or length of flue gas passes is large, advantageous supporting of the common wall may also need a new arrangement for and a new method of supporting the common wall.

An object of the present invention is to provide means for supporting a wall in a steam generator wherein at least part of the above mentioned disadvantages is minimized or eliminated.

SUMMARY OF THE INVENTION

The above cited problems of the prior art are solved or at least minimized by the solutions defined in the appended independent claims. The dependent claims define advantageous embodiments of the present invention.

According to one aspect, the present invention provides an arrangement for horizontally supporting a first side wall of a top-supported vertical flue gas pass in a thermal power steam generator, wherein the first side wall comprises evaporative water tubes for conveying a mixture of water and steam at a first temperature, and the vertical flue gas pass comprises a superheating tube for conveying steam at a second temperature higher than the first temperature, the superheating tube comprising multiple rigid, horizontally extending tube legs extending across the flue gas pass from the proximity of the first side wall to the proximity of a second side wall opposite to the first side wall in the flue gas pass, wherein the superheating tube is supported from above by a hanger that is in operation at a third temperature higher than the first temperature, wherein the rigidity of the first side wall is increased by each of the rigid, horizontally extending tube legs comprising first and second end sections, each of the first and second end sections being attached to the proximate side wall by an attaching means, which attaching means allows relative movement between the respective end section and the proximate side wall only in a direction of relative thermal movement between the end section and the proximate side wall.

The rigidity of the first side wall is thus advantageously increased by each of the rigid, horizontally extending tube legs comprising a first end section attached to the first side wall by first attaching means and a second end section attached to the second side wall by second attaching means, which first and second attaching means allow relative movement of the first and second end sections with respect to the side wall to which the end section is attached only in direction of relative thermal movement between the end section and the side wall the end section is attached to.

A main object of the present invention is to provide additional horizontal support for the first side wall of the flue gas pass. Additional horizontal support for the first side wall is, according to an embodiment of the present invention, obtained by using the multiple horizontal legs of the superheating tube to transfer horizontal loads from the first side wall to the second side wall. This is especially useful when the second side wall is more rigid than the first side wall due to, for example, an external horizontal support structure. The difference in the rigidity of the side walls may be based on having multiple strong buckstays arranged outside the second side wall but not outside the first side wall. As is well-known to persons skilled in the art, conventional buckstays are supporting elements used to minimize deformations of a wall in the direction of the normal of the wall. It is, however, also possible that the higher rigidity of the second side wall is based on any other suitable means, such as on hanging or to ground supported beams arranged outside the second side wall to support it.

In case there is an evaporating heat exchanger in a flue gas pass enclosed by side walls formed of evaporative water tubes, the rigidity of the flue gas pass can be increased simply by attaching suitable parts of the evaporating heat exchanger firmly to opposite side walls of the flue gas pass. However, the present invention relates to another case, to a case of having a superheater tube within the flue gas pass. Because the superheater tube heats in operation to a temperature, typically to more than 500 Deg C., which is clearly higher than that of the evaporative water tubes comprising side walls, typically on the order of 300 Deg C., the superheater tube cannot, due to different thermal expansion, be firmly attached to opposite side walls of the flue gas pass.

Temperature of evaporating water tubes of a natural circulation boiler is substantially constant, depending on the operation pressure, but for a supercritical steam generator the temperature of the evaporating water tubes varies along the tube length. Also the temperature of a superheating tube is generally not constant but varies along the tube length. Correspondingly, the above mentioned first and second temperatures, as well as the third temperature, may in practice mean ranges of temperatures. Possible operation temperatures and temperature ranges of different parts of the steam generator are anyhow determined in the design phase of the steam generator, and can be taken into account when designing the attaching means between the first and second end sections of the horizontally extending superheater tube legs and the side walls the end sections are attached to.

According to the present invention, rigidity of the first side wall is increased by the combination of (a) supporting the superheating tube from above by a hanger that is in operation at a higher temperature than the evaporating temperature and (b) attaching horizontally extending tube legs of the superheating tube by attaching means that allow relative movement of the end sections of the tube legs with respect to the adjacent side wall only in direction of relative thermal movement between the end section and the adjacent side wall. Below will be described in details how the feature (b) above renders it possible to increase the rigidity of the first side wall, and how the feature (a) is needed to achieve the feature (b).

The hanger advantageously comprises a hanger tube or a system of hanger tubes that, in operation, contain steam at a temperature higher than that of the evaporation tubes. The hanger tube or system of hanger tubes is advantageously in steam flow connection with the superheating tube. Steam to be superheated is preferably conveyed by the hanger tube from a steam header above the flue gas pass down to the lower most portion of the superheating tube, which hanger tube is arranged so as to provide vertical support to the superheating tube. Operation temperature of the hanger tube is naturally also determined in the design phase, and can be taken into account when designing the above mentioned attaching means of the end sections of the horizontally extending superheater tube legs.

Due to supporting the superheater from above, each of the horizontal legs comes down by a definite amount, depending on its vertical position, when heated to the operation temperature. In addition to that, each of the horizontally extending tube legs expands axially, in the direction of the leg. On the other hand, the evaporative water tubes comprising side walls also expand both downwards and horizontally during their heating to the operation temperature, but, due to their smaller temperature change, less than the superheater tube.

Vertical and horizontal relative thermal movements in the attachment between any end section of a tube leg and the side wall to which the end section is attached, depends on their differential temperature change and on the position of the attachment. However, the ratio of vertical and horizontal relative thermal movements is substantially constant on each attachment. Thus, the relative thermal movement has in each attachment position a definite direction, and it is possible to make the attaching means such that it allows relative movement in that particular direction but prevents relative movements in any other directions. In practice there has to be some tolerances in the design of the attaching means, but they do not preclude their functioning in horizontal supporting of the side walls as described below.

Because the hanger of the superheating tube is in operation heated to a higher temperature than the side walls of the flue gas pass, the relative thermal movements in the attachments between the end sections of the tube legs and the side walls to which the end sections are attached to is not only in a horizontal direction but they always have a vertical component, too. Therefore, the attaching means are according to the present invention formed so that they do not allow relative movement directed in horizontal direction. Due to this construction, the horizontal legs of the superheater tube provide an in horizontal direction rigid structure, and thus they provide support to the side walls in that direction.

According to the prior solution described in GB837994A a bank of sinuous superheater tubes is on and in sliding contact with support lugs welded to opposite wall tubes, whereby the superheater tubes do not support to the walls in a horizontal direction. The document GB892639 discloses an upright superheater tube platen comprising nested, sinuous tubes with tube legs horizontally extending across the gas pass, wherein each outermost return bend is fixed relatively to the boundary of a gas pass whilst each tube including an inner return bend is supported from the tube including the outer return bend so as to allow relative longitudinal movement between the tube legs. Thus, due to the allowed relative longitudinal movement between the tube legs, such a tube platen does not support to the walls in horizontal direction.

The superheating tube defined above as a feature of the present invention may also in practice form an upright superheater tube platen comprising nested, sinuous tubes, similarly as shown in GB892639, but, in that case, adjacent nested tube legs of a tube platen have to be fixed relative to each other so as to form combined, rigid horizontally extending legs that enable supporting a side wall of the flue gas pass in the horizontal direction.

A reason for the need to provide additional support for the first side wall may be that the first side wall is a common wall between the vertical flue gas pass comprising a superheating tube with multiple horizontally across the flue gas pass extending tube legs and an adjacent, earlier vertical flue gas pass upstream of the superheater tube comprising vertical flue gas pass. To improve clarity, the above discussed vertical flue gas pass that comprises the superheating tube is here after also called the second flue gas pass and the adjacent, earlier vertical flue gas pass is called the first flue gas pass. Such a first flue gas pass is often without a superheating tube, but it is also possible that within the first flue gas pass is a superheating tube, or other heat recovery devices, too. The present invention provides a new way of supporting the common wall, by attaching horizontal legs of the superheating tube to the first and second side walls of the first flue gas pass in a suitable way, to be described more in details below.

According to an embodiment of the present invention, the first flue gas pass is a furnace, for example, the furnace of a fluidized bed boiler in an over-the-top configuration. Thus, in that embodiment, the second flue gas pass is a section of the flue gas duct of the boiler that comprises a common wall with the furnace. Because there is an intense flow of hot flue gas in the second flue gas pass, and also in the furnace, buckstays or other conventional supporting structures arranged on the common wall would generally create a risk of rapid wearing of the structure or obstruction of the flue gas flow. Therefore, a common wall between a furnace and a flue gas pass generally cannot be supported by conventional external supporting structures, and there is a need for supporting the common wall by an arrangement according to the present invention.

According to another embodiment of the present invention, the first flue gas is a vertical flue gas pass downstream of the furnace, i.e., between the furnace and the second flue gas pass. An example of such an application is a waste firing fluidized bed boiler having a down flow empty pass upstream of an up flow convective section, i.e., the second flue gas pass, to cool down flue gas before it comes into contact with a superheating tube in the second flue gas pass. In such an arrangement, there is often a common wall between the empty pass, i.e., the first flue gas pass, and the second flue gas pass. Because there is an intense flow of hot flue gas flow on both sides of the common wall, the common wall generally cannot be strengthened by buckstays or other conventional external supporting structures, and there may again be a need for supporting the common wall by an arrangement according to the present invention.

According to a further embodiment of the present invention, horizontal legs of the superheating tube are used to form a rigid structure within a flue gas pass in order to provide additional support for both the first and second side walls. Thus, this embodiment is useful even if there is no difference in the rigidity of the first and second side walls, but there is a need to symmetrically reinforce both the first and second side walls with a rigid support structure within the flue gas pass. The use of the multiple horizontal legs of a superheating tube for that purpose is advantageous because then no new structure is added to the flue gas pass. Instead of a new structure, only the superheating tube, which is in any case in the flue gas pass, is attached to the side walls in a special way. Such a rigid structure inside the flue gas pass renders it possible to decrease the number or strength of external supporting structures, such as buckstays, on the first and second side walls of the flue gas pass. Thereby, the solution minimizes the weight and costs of the supporting structure of a conventional vertical flue gas pass.

It is to be noted that the first and second side walls can be reinforced as described above in case the superheating tube comprises tube legs extending across the flue gas pass between the first and second side walls. However, generally, the vertical flue gas pass is enclosed by four side walls that all comprise evaporative water tubes for conveying a mixture of water and steam in the first temperature, and naturally it would in many applications be advantageous to provide additional support to all the four side walls. Correspondingly, according to a still further embodiment of the present invention, the superheating tube comprises a first set of horizontally extending tube legs extending across the flue gas pass between the first and second side walls and a second set of horizontally extending tube legs extending across the flue gas pass perpendicular to the first set of tube legs. Thereby, the second set of horizontally extending tube legs advantageously extends between a third side wall and a fourth side wall opposite to the third side wall, wherein each of the third and fourth side walls is located between the first and second side walls. Similarly to the first set of horizontally extending tube legs, the second set of horizontally extending tube legs can then be used to provide additional support to the third and fourth side walls. Thereby, such a construction with perpendicular horizontally extending tube legs can be used to support all four side walls of a flue gas pass.

Each of the attaching means between the end sections of the horizontally extending tube legs and the side walls to which the end sections are attached to advantageously comprises a wall part attached to a side wall and a tube part attached to a horizontally extending tube leg. Preferably, the wall parts and the tube parts are steel pieces welded to the side walls and the end sections of the superheater tube legs, respectively. One of the wall part and the tube part of every attaching means, say the wall part, advantageously comprises two vertically extending plates arranged side by side, each having a vertically extending oblong slot. The other part, say the tube part, advantageously comprises a transverse piece, say a strong metal pin or slab attached by a rod to the tube, which transverse piece is arranged to be movable in the slots. According to an advantageous embodiment, the transverse piece is a metal slab that extends in the same direction as the slots.

The feature that the attaching means allows relative movement of the end section with respect to the side wall only in a direction of their relative thermal movement is achieved by having the direction of the slots, and possibly also that of the transverse piece, to correspond to the relative thermal movement. Therefore, the horizontally extending legs of the superheating tube are attached to the side walls of the flue gas pass with sliding supports, wherein the attaching means provide a connection that is sliding in the direction of the relative thermal movement, but rigid in other directions.

It is to be noted that generally one of the side walls of the second flue gas pass can be used, in a horizontal direction, as a thermal movement reference line, wherein only vertical thermal movement is allowed. Attaching means to be used at such a wall thus have vertically extending slots, and possibly also vertically extending transverse pieces. Especially, in case the second side wall is, due an external horizontal support structure, more rigid than the first side wall, the second side wall is advantageously used as the thermal movement reference line. Because the horizontally extending legs of the superheating tube necessarily undergo horizontal thermal expansion, attaching means attached to the end sections of the horizontally extending legs opposite to the thermal movement reference line necessarily have slots, which are slanted from the vertical direction. Especially, in case the horizontal legs of the superheating tube are used to provide additional support to both the first and the second side walls, the attaching means at both ends of the horizontally extending legs of the superheating tube advantageously have slots, which are slanted from the vertical direction.

Generally, the lower a horizontally extending leg of the superheating tube is located in the flue gas pass, the higher is the ratio of the vertical and horizontal relative thermal movements, and the smaller is the angle between the vertical direction and the direction of the slots at the end sections of the leg. Correspondingly, the higher a horizontally extending leg of the superheating tube is located in the flue gas pass, the lower is the ratio of the vertical and horizontal thermal movements and the larger is the angle between the vertical direction and the direction of the slots at the end sections of the leg.

It is to be noted that because the superheating tube is supported from above by a hanger that is in operation at a temperature higher than the evaporation temperature, i.e., the temperature of the first and second side walls, vertical thermal movement of each horizontally extending leg of the superheating tube is higher than that of the adjacent side walls, and there is always a vertical component in their relative thermal movement. Therefore, the direction of all slots deviate from horizontal direction. If the hanger and the walls of the second flue gas pass would have same temperature, the attaching means would provide sliding connection in the horizontal direction, and the side walls could not be in horizontal direction supported with the horizontally extending legs of the superheating tube. Because of the vertical component in the direction of slots of the attaching means, the attaching of the horizontally extending legs to the side walls is rigid in the horizontal direction. Thereby, the present solution uses thermal movement differences to its advantage to support to the side walls against loads, due to, for example, overpressure or underpressure in the flue gas pass, in the direction of the normal of the side walls.

According to another aspect, the present invention provides method of horizontally supporting a first side wall of a top-supported vertical flue gas pass in a thermal power steam generator, according to any one of the embodiments described above. Thus, the method comprises the steps of conveying a mixture of water and steam at a first temperature in evaporative water tubes of the first side wall, conveying steam at a second temperature higher than the first temperature in a superheating tube arranged within the vertical flue gas pass, the superheating tube comprising multiple rigid, horizontally extending tube legs extending across the flue gas pass between the first side wall and a second side wall of the flue gas pass opposite to the first side wall, supporting the superheating tube from above by a hanger that is at a third temperature higher than the first temperature, increasing rigidity of the first side wall by horizontally supporting the first side wall by attaching a first end section and a second end section of each of the multiple rigid, horizontally extending tube legs to the first side wall and to the second side wall, respectively, by an attaching means, wherein the attaching means are formed so as to allow relative movement of each of the first and second end sections with respect to the side wall the end section is attached to only in direction of relative thermal movement between the end section and the side wall to which the end section is attached.

The above brief description, as well as further objects, features, and advantages of the present invention will be more fully appreciated by reference to the following detailed description of the presently preferred, but nonetheless illustrative, embodiments in accordance with the present invention, when taken in conjunction with the accompanying drawings.

DETAILED DESCRIPTION OF THE INVENTION

Figure 1:
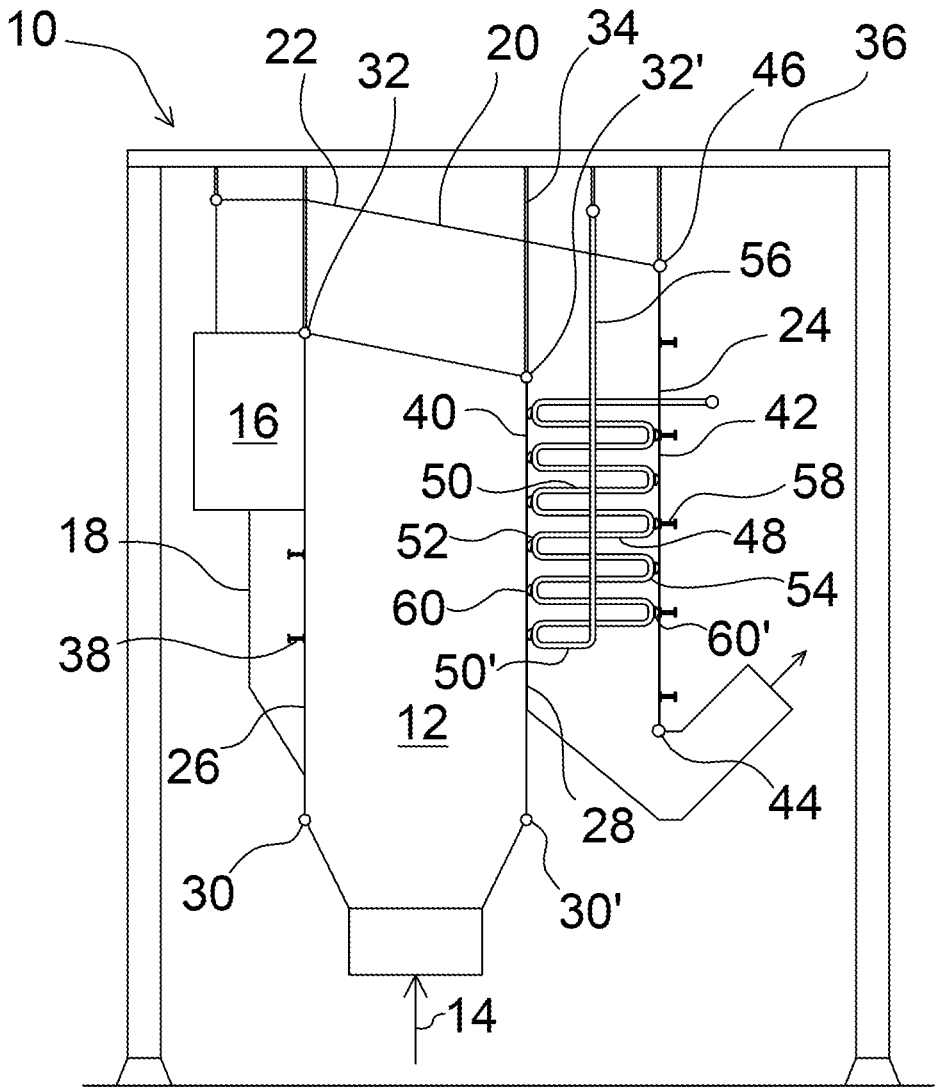
FIG. 1 schematically illustrates a fluidized bed boiler comprising an arrangement according to a first preferred embodiment of the present invention.

The diagram of FIG. 1 schematically illustrates a thermal power steam generator, more specifically, a fluidized bed boiler 10, comprising an arrangement according to a first preferred embodiment of the present invention. FIG. 1 shows a conventional circulating fluidized bed boiler comprising a furnace 12, wherein a bed of particles is fluidized with a stream of air 14 so as to combust fuel introduced to the furnace with the air. In other applications of the present invention, there could be another type of a flue gas generating thermal power boiler than a fluidized bed boiler, such as a waste incinerator or a gas turbine power plant. In the application shown in FIG. 1, the combustion process generates flue gas, which is conveyed from the upper part of the furnace to a particle separator 16, wherein a portion of particles entrained by the flue gas is separated from the flue gas to be returned back to the furnace 12 via a return duct 18. Cleaned flue gas emanates from the particle separator 16 to a flue gas duct 20 comprising first a horizontal pass 22 extending over the top of the furnace 12 and then a down flow vertical flue gas pass 24, from where the flue gas is conveyed to further flue gas handling stages, not shown in FIG. 1.

Vertical side walls 26, 28 of the furnace 12 are cooled in a conventional way by forming them as conventional tube walls, in which water is evaporated to steam. Thus, the water tubes in operation convey a mixture of water and steam from lower headers 30, 30' to upper headers 32, 32' and from there, in case of a natural circulation boiler, to circulate via a steam drum, not shown in FIG. 1. The side walls 26, 28 are thus in operation in the evaporation temperature, which depends on the pressure of the mixture. In view of the present invention, the boiler can alternatively be a supercritical once-through steam generator, in which water is gradually converted to steam, and there is no steam drum.

The furnace 12 and the vertical flue gas pass 24 of the flue gas duct 20 are top-supported, i.e., they are hanging by suitable hanger rods 34 from a conventional support structure 36 extending above the furnace 12. External side walls 26 of the furnace 12 are supported against horizontal loads by conventional wall supporting structures, such as buckstays 38. As is well known to persons skilled in the art, such a fluidized bed boiler comprises also many other elements and features relating to, for example, fuel feeding, ash discharging, steam generation, and flue gas cleaning, which are, however, omitted from FIG. 1, because they are not important for the present invention.

Because flue gas flows in operation of the boiler to the upper portion of the furnace 12, the furnace 12 can be called the first flue gas pass. Correspondingly, the down flow vertical flue gas pass 24 is in the following called the second flue gas pass. The second flue gas pass 24 is generally enclosed by four vertical side walls, of which a first side wall 40, the front wall of the second flue gas pass, and a second side wall 42, rear wall of the second flue gas pass, can be seen in FIG. 1. All the four vertical side walls are conventional evaporative tube walls, which in operation convey a mixture of water and steam from lower headers 30', 44 to upper headers 32', 46, and from there, in case of natural circulation, to the steam drum. The side walls of the second flue gas pass are thus in operation in the evaporation temperature, which depends on the pressure of the mixture.

The front wall 40 is a common wall with the furnace 12, i.e., the front wall 40 of the second flue gas pass 24 is the same as the rear wall 28 of the furnace 12. Thus, according to the embodiment of the invention shown in FIG. 1, the flue gas flow direction is substantially opposite on different sides of the common wall 40. In the furnace side the flow is substantially upwards and in the down flow vertical flue gas pass 24, it is substantially downwards. The second side wall 42, as well as the third and fourth side walls, of the second pass, which are not seen in FIG. 1, are conventional external walls.

The second flue gas pass 24 comprises a superheating tube 48 conveying steam to increase its temperature from that of a preceding stage, typically an earlier superheating stage, to a higher temperature. Thus, the superheating tube 48 is always at a higher temperature higher than the vertical side walls 40, 42 of the second flue gas pass 24. The superheating tube 48 is advantageously of a conventional sinuous type comprising multiple horizontally extending tube legs 50, which extend across the flue gas pass 24 between the first and second side walls 40, 42. The horizontally extending legs 50 are connected in series by first and second end sections 52, 54, on the sides of the first and second side walls 40, 42 of the second flue gas pass 24, respectively. The superheating tube 48 can alternatively be of another type having corresponding horizontally extending legs connected in series by end sections on the sides of the first and second side walls.

In the embodiment shown in FIG. 1, the superheating tube is vertically supported from above by a hanger tube 56, which is supported from above, preferably from the supporting structure 36, and is mainly located within the vertical flue gas pass 24. The hanger tube 56 is in steam flow connection with the lower most horizontally extending leg 50' of the superheating tube. More specifically, the hanger tube 56 is used to feed steam to the superheating tube 48, and thus functions also as a superheater. Thus, the temperature of the hanger tube 56 is always higher than that of the vertical side walls 40, 42 of the second flue gas pass 24. In other applications of the present invention, the superheating tube can alternatively be supported by another type of hanger, such as a separate from above hanging support construction, which is arranged within the flue gas pass so that it in operation heats up to a temperature higher than the temperature of the side walls of the second flue has duct.

The second side wall 42, as well as the third and fourth side walls, of the second flue gas pass 24, are advantageously supported against horizontal loads by suitable wall support structures, such as conventional buckstays 58. Because the first side wall 40 is a common wall with the furnace, it cannot, due to intensive flow of hot flue gas on both sides of the wall, be supported against horizontal loads by buckstays. Therefore, in accordance with the present invention, rigidity of the first side wall 40 is increased by horizontally supporting the first side wall 40 by having the first and second end sections 52, 54 of each of the multiple horizontally extending tube legs 50 attached to the first and second side walls 40, 42, respectively, by suitable attaching means 60, 60'. According to the present invention, the attaching means allow relative movement of each of the first and second end sections 52, 54 with respect to the first and second side walls 40, 42, respectively, only in a direction of relative thermal movement between the end section and the side wall into which the end section is attached. Examples of possible designs of the attaching means are explained below in connection with FIGS. 6*a* and 6*b*.

Because the hanger tube 56 is heated to a higher temperature than the side walls 40, 42, the relative thermal movements between the end sections and the side walls into which the end sections are attached always have a vertical component. Therefore, as described above, the attaching means do not allow purely horizontal movements between the end sections 60, 60' and their adjacent side walls 40, 42, but allowed movements always have a vertical component. Thus, the arrangement of the horizontally extending legs 50 in the flue gas pass 24 is rigid in a horizontally direction. Therefore, the rigidity of the first side wall 40 is increased, according to the embodiment of the present invention shown in FIG. 1, by utilizing the horizontal legs 50 of the superheating tube 48 for transferring horizontal loads from the first side wall 40 to the second side wall 42.

Figure 2:
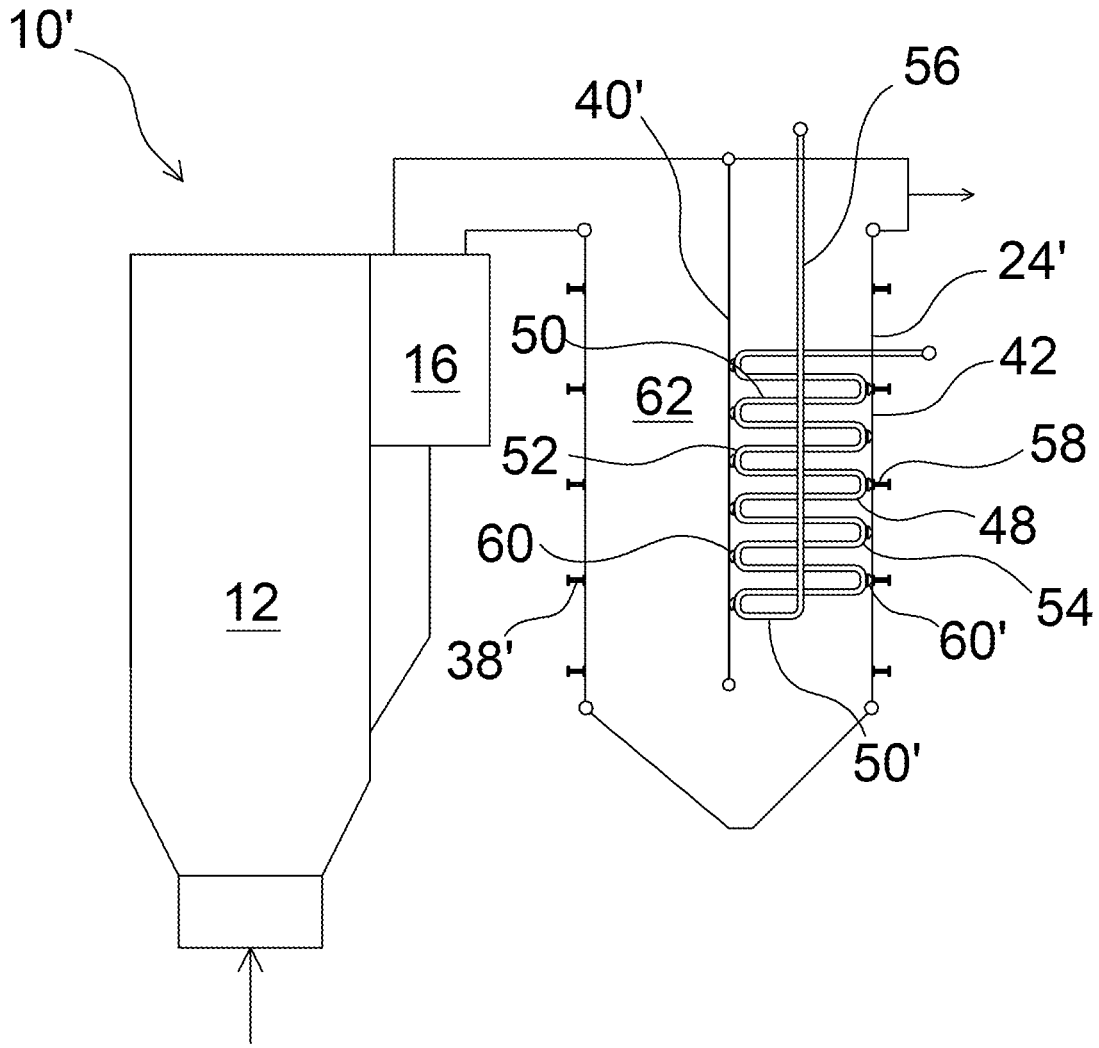
FIG. 2 schematically illustrates another fluidized bed boiler comprising an arrangement according to a second preferred embodiment of the present invention.

The diagram of FIG. 2 schematically illustrates a thermal power steam generator, more specifically, a fluidized bed boiler 10', comprising an arrangement according to a second preferred embodiment of the present invention. The embodiment of FIG. 2 differs from that of FIG. 1 in that the fluidized bed boiler 10' is a waste-to-energy boiler, in which flue gases emanating from the furnace 12 are first cooled in a down flow empty pass 62 before they enter to an up flow second flue gas pass 24'. All elements in FIG. 2, which are in principle identical to corresponding elements in FIG. 1, are referenced by the same reference numbers as in FIG. 1. When there is a difference that is, however, not relevant in view of the present invention, the reference number used in FIG. 2, or correspondingly in the other FIGS. 3 to 6, is same as that in the previous figure, but added with an apostrophe.

In the embodiment of FIG. 2, there is a common wall 40' between the empty pass 62 and the up flow flue gas pass 24'. Thus, the empty pass 62 is in this case the first flue gas pass, and the up flow flue gas pass 24' is the second flue gas pass. The common wall 40' is a rear wall of the first flue gas pass 62 and a front wall of the second flue gas pass 24'. In the second flue gas pass is arranged a superheating tube 48, which is principally identical with that shown in FIG. 1.

The front wall of the first flue gas pass 62 and the rear wall of the second flue gas pass 24' are external walls, which are externally supported by conventional buckstays 38', 58. Normally there are no large pressure differences between the sides of the common wall 40' but for a common wall having especially large width and/or height, there may be a need to enforce the wall against horizontal loads. The enforcing of the common wall 40' can advantageously be performed similarly as enforcing of the common wall 40 in the embodiment of FIG. 1, by attaching first and second end sections 52, 54 of the horizontally extending legs 50 of the superheating tube 48 by suitable attaching means 60, 60' to the first and second side walls, i.e., to the common wall 40' and the rear wall 42 of the second flue gas pass.

Figure 3:
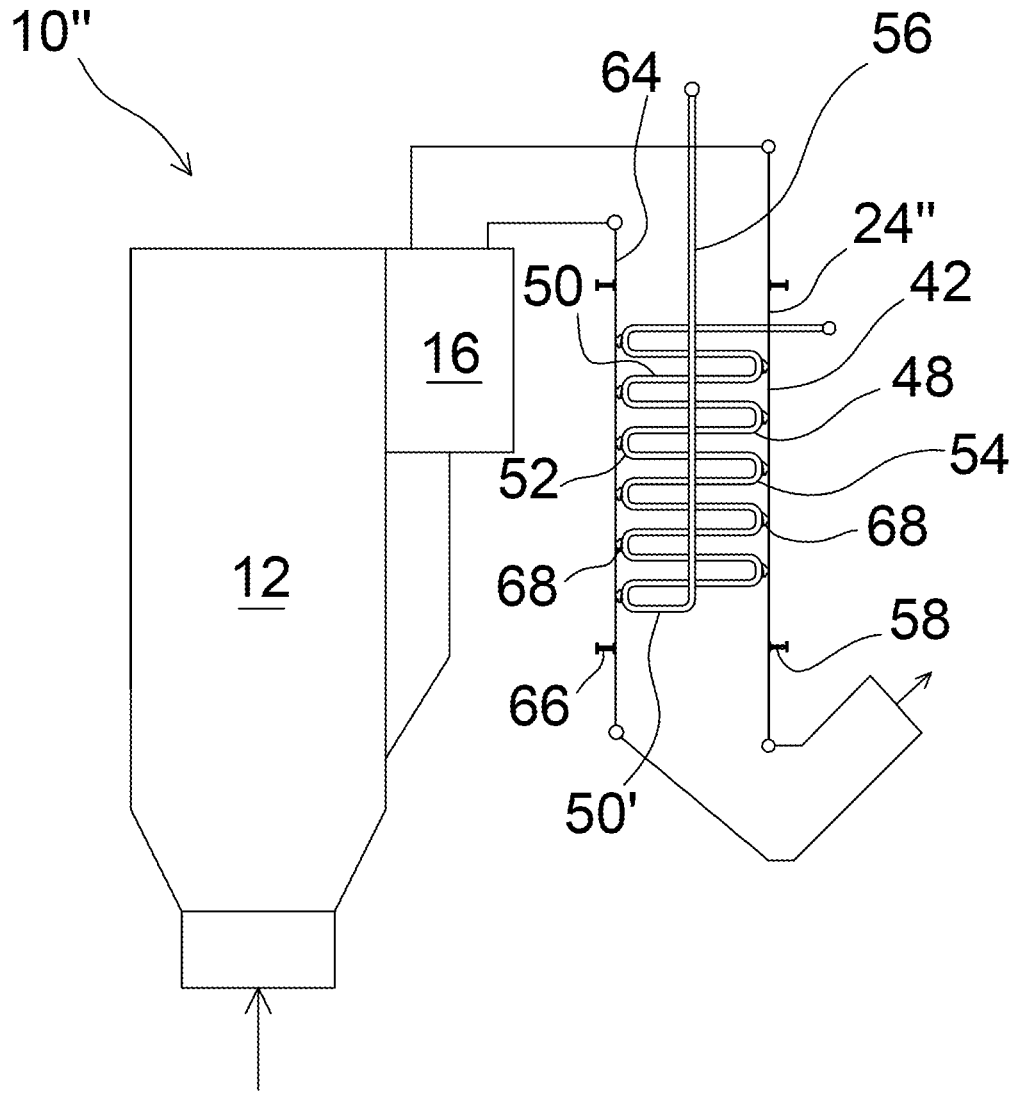
FIG. 3 schematically illustrates a still another fluidized bed boiler comprising an arrangement according to a third preferred embodiment of the present invention.

The diagram of FIG. 3 schematically illustrates a fluidized bed boiler 10" comprising an arrangement according to a third preferred embodiment of the present invention. The embodiment in FIG. 3 differs from that in FIG. 2 in that the second flue gas pass 24" does not have a common wall with a preceding flue gas pass, and the superheating tube 48 within the second flue gas pass is used to horizontally support both the front wall 64 and the rear wall 42 of the second flue gas pass.

Because of the horizontal support provided by the horizontally extending legs of the superheating tube 48 to a vertically central region of the second flue gas pass, external buckstays or other external supporting devices can be omitted or minimized in this region. However, vertical regions above and below the central region can still be provided by conventional buckstays 66, 58, or other suitable support structures.

In the common wall comprising embodiments shown in FIGS. 1 and 2, the attaching means 60 at the common wall 40 advantageously differ from the attaching means 60' at the external wall 42 as will be explained in connection with FIGS. 6*a* and 6*b*. In the embodiment of FIG. 3, both the front wall 64 and the rear wall 42 of the second flue gas pass 24" are external walls, and therefore the attaching means 68 at the front wall 64 and the rear wall 42 are preferably identical with each other.

Figure 4:
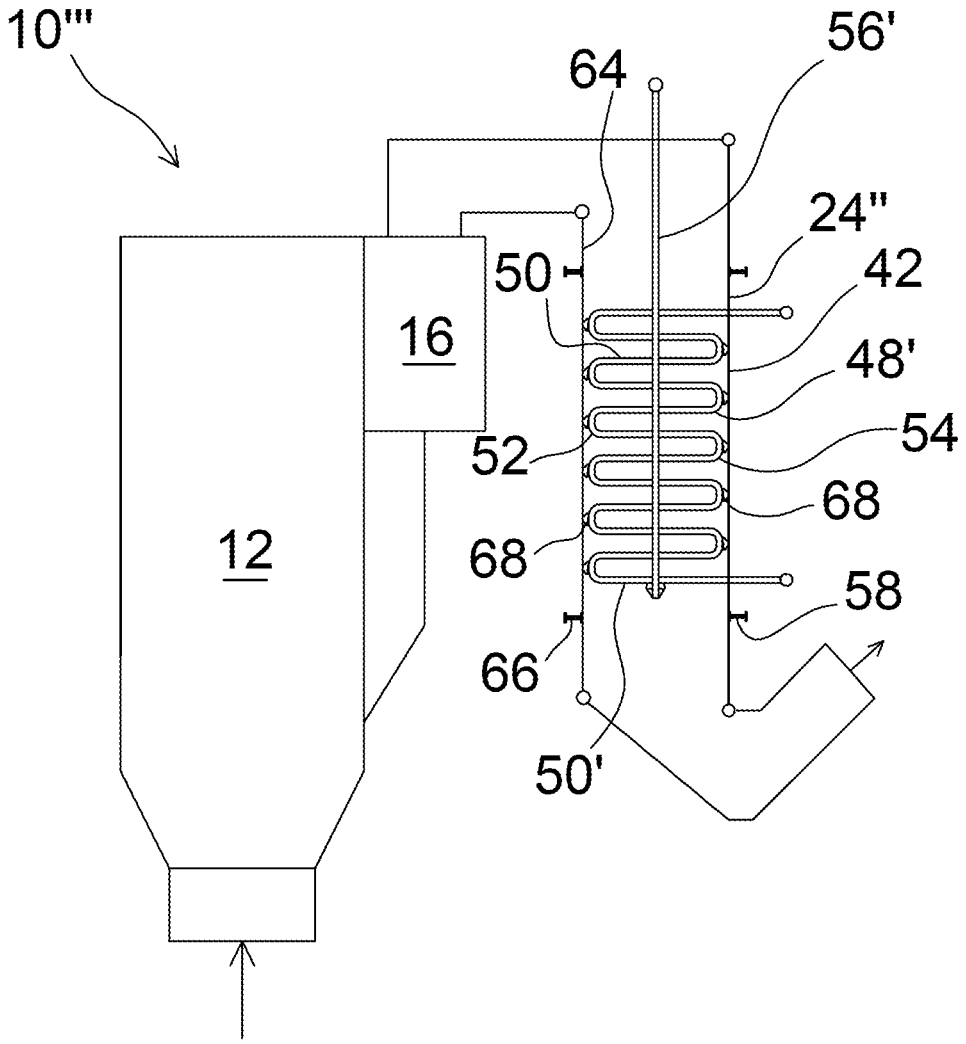
FIG. 4 schematically illustrates a fluidized bed boiler comprising an arrangement according to a fourth preferred embodiment of the present invention.

The diagram of FIG. 4 schematically illustrates a fluidized bed boiler 10'", comprising an arrangement according to a fourth preferred embodiment of the present invention. The embodiment in FIG. 4 differs from that in FIG. 3 only in that the superheating tube 48' is not supported from above by a hanger tube that feeds steam to the superheating tube 48', but by a separate hanger 56', for example, a from above hanging pipe or rod, that is arranged in the flue gas pass so that it in operation heats up to a temperature higher than the temperature of the side walls of the second flue has duct. A separate hanger 56' as shown in FIG. 4 can naturally also be used in many other embodiments, for example, in the embodiments shown in FIGS. 1 to 3, of the present invention.

Figure 5:
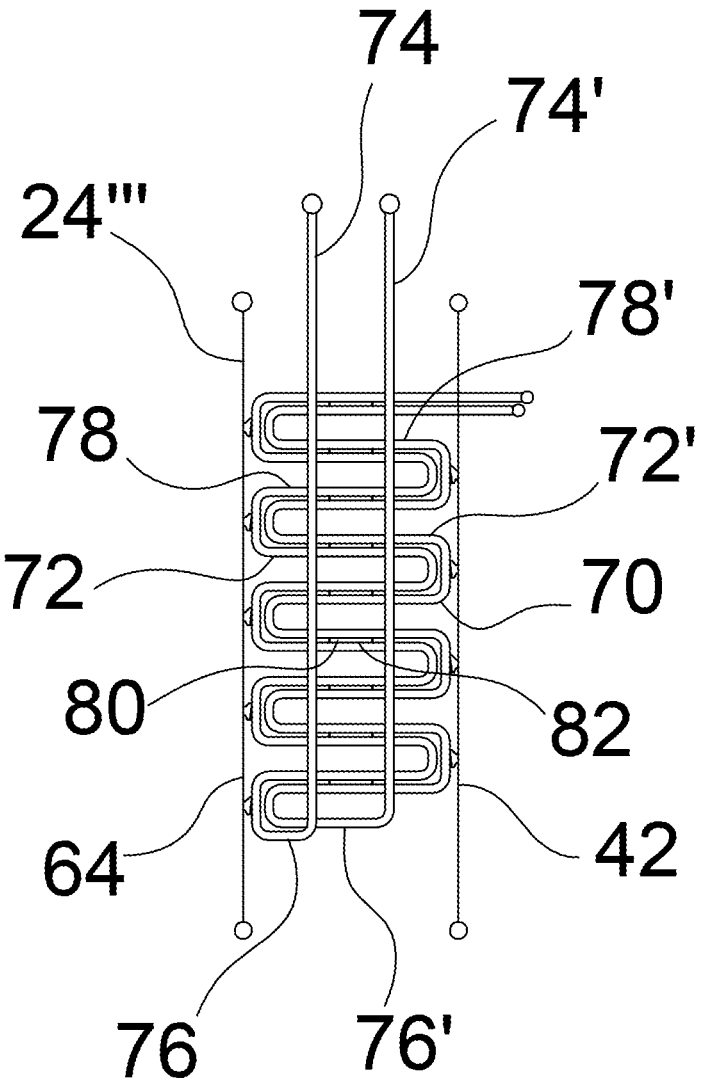
FIG. 5 schematically illustrates an arrangement according to a fifth preferred embodiment of the present invention.

The diagram of FIG. 5 schematically illustrates an example of an arrangement of a superheating tube 70 in a flue gas pass 24'", which can be used in different applications of the present invention, for example, in any of the embodiments shown in FIGS. 1, 2, and 3. The arrangement comprises two nested sinuous tubes 72, 72', each of which being vertically supported by a hanger tube 74, 74', which is in steam flow connection with the lower most horizontally extending leg 76, 76' of one of the sinuous tubes 72, 72'. As is clear to a person skilled in the art, an arrangement of nested sinuous tubes can alternatively be supported from above by a separate hanger, as shown in FIG. 4.

Each of the nested sinuous tubes 72, 72' comprises multiple horizontally extending legs 78, 78' that are pairwise attached together by suitable attaching pieces 80 to form combined, rigid horizontally extending legs 82. The combined, rigid horizontally extending legs 82 are attached to the side walls 64, 42 of the flue gas pass 24'" in the same way as, for example, in the embodiment of FIG. 3 to provide horizontal support to the side walls 64, 42. In practice the superheating tube 70 can comprise even more than two nested sinuous tubes, such as three or four sinuous tubes. In each end section of such a combined superheating tube, the outermost tube is attached to an adjacent side wall by a suitable attaching means, but all the tubes form combined, rigid horizontally extending legs as described above, so as to provide horizontal support to the adjacent side walls.

Figure 6A:
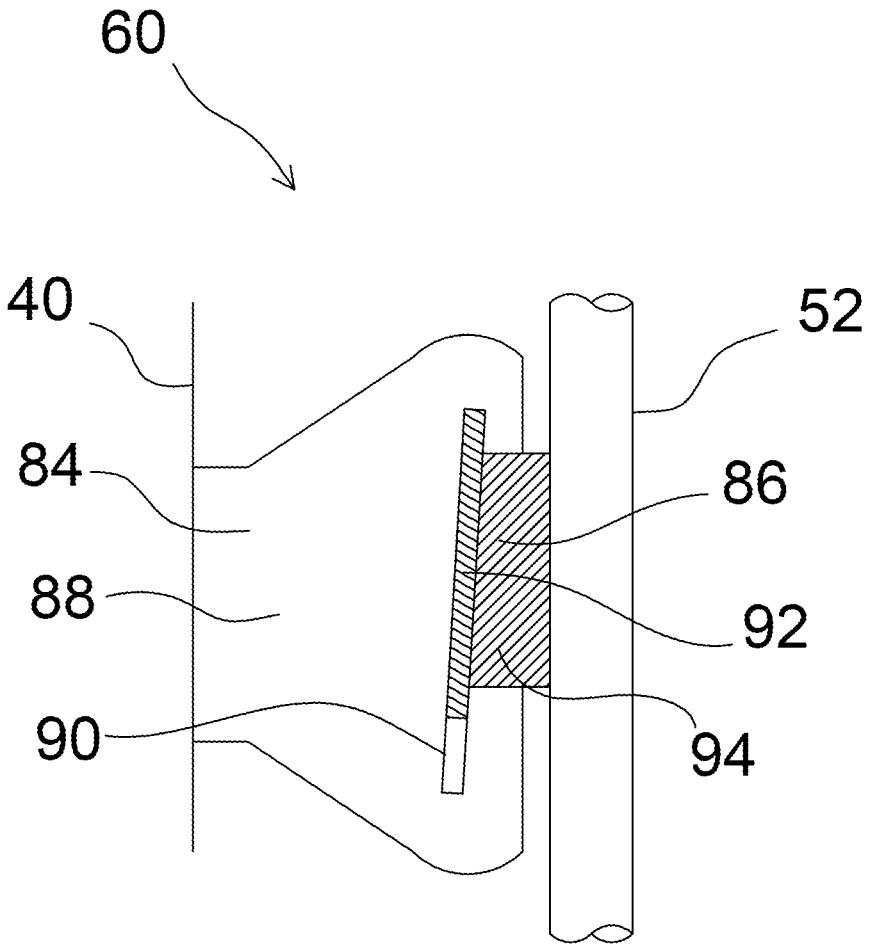
FIGS. 6*a* and 6*b* schematically illustrate details of an arrangement according to an embodiment of the present invention.

The diagram of FIG. 6*a* schematically illustrates a vertical cross section of an exemplary attaching means 60 to be used for attaching an end section 52 of a horizontally extending tube leg of a superheating tube to a side wall 40 of a flue gas pass, in accordance with the present invention. The attaching means comprises a wall part 84 attached by a suitable method, such as welding, to the side wall 40 and a tube part 86 attached by a suitable method, such as welding, to the end section 52. The wall part comprises advantageously two vertically extending metal plates 88 arranged side by side, one of which is seen in FIG. 6*a*, each of the plates having an oblong slot 90, which is to some extent slanted from the vertical direction. The tube part 86 advantageously comprises a transverse metal slab 92 attached by a rod 94 to the end section 52 of the tube. The transverse metal slab 92 extends in the same direction as the slots and is arranged to be movable in the slots.

FIG. 6*a* shows the attaching means 60 in ambient temperature, i.e., when the horizontal and vertical dimensions of the superheating tube, as well as those of the side wall 40 of the flue gas pass, have their low temperature lengths. When the steam generator is heated up to its operation temperature, the superheating tube and its hanger, which is not seen in FIG. 6*a*, are thermally expanded more than the flue gas pass, whereby the end section 52 moves in the flue gas pass downwards and towards the sidewall 40. This relative thermal movement is possible thanks to the oblong slots 90, which are slanted outwards in the downward direction.

As discussed above, the direction of the slots 90 and the slab 92 are arranged to correspond to the relative thermal movement between the wall 40 and the end section 52 of the superheating tube taking place in the location of the attaching means. Therefore, the attaching means 60 allows relative movement of the end section 52 with respect to the side wall 40 only in a direction slanted from the vertical direction, and more specifically, only in a direction of their relative thermal movement. The connection is thus sliding in the direction of the relative thermal movement, but rigid in other directions, and provides horizontal support to the side wall 40.

Figure 6B:
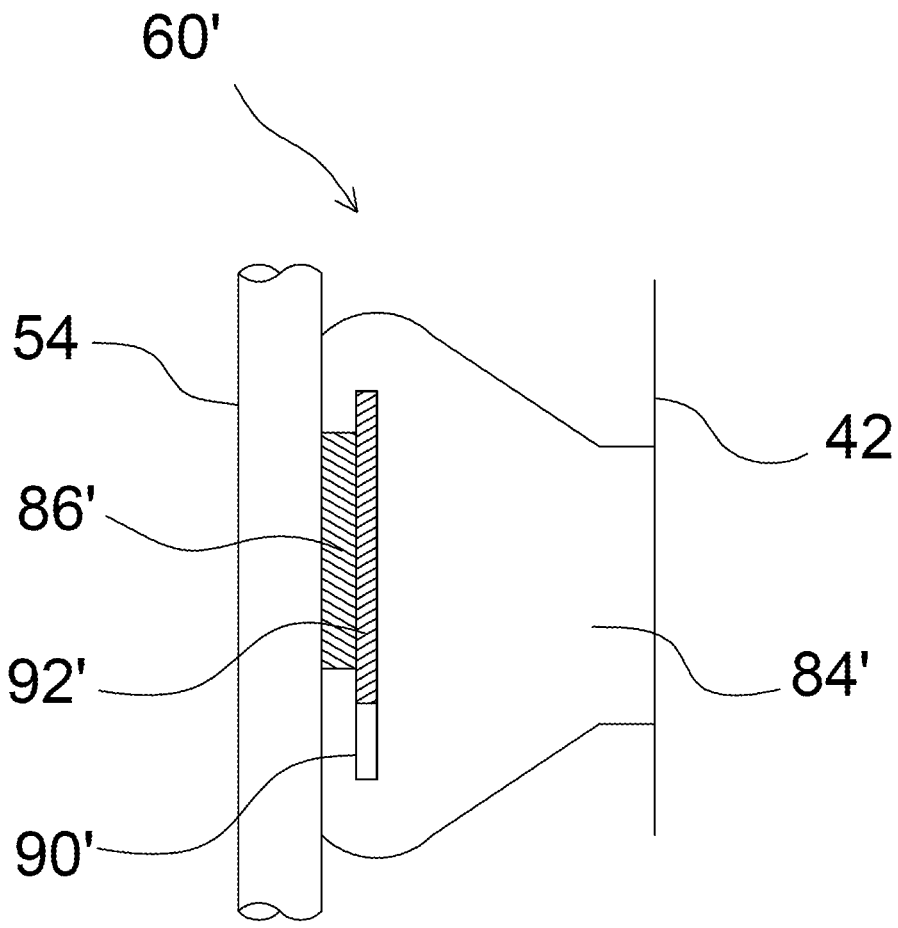

The diagram FIG. 6*b* schematically illustrates a vertical cross section of another exemplary attaching means 60' to be used for attaching an end section 54 of a horizontally extending tube leg of a superheating tube to a side wall 42 of a flue gas pass. The attaching means 60' differs from the attaching means 60 in FIG. 6*a* only in that the slots 90' in the wall part 84' and the slab 92' in the tube part 86' are vertical instead of slanted. Thus, the attaching means 60' allows only vertical relative thermal movement, mainly caused, as explained above, by a hanger, not shown in FIG. 6*b*, between the wall 42 and the end section 54 of the superheating tube. Relative horizontal thermal movement is thus prevented by the attaching means 60', and has to be in full enabled in the other end of the respective horizontally extending tube leg, by an attaching means, for example, as shown in FIG. 6*a*. The attaching means 60' is used to provide a thermal movement reference line in a horizontal direction. Preferably, such an attaching means with vertical slots and slabs are used when connecting a superheating tube to an externally supported side wall, such as side walls 42 in FIGS. 1 and 2, to provide a horizontal thermal reference line therein. Because of horizontal thermal expansion, an attaching means allowing purely vertical movement can only be used in at most one of opposite side walls of a vertical flue gas pass.

As is clear to a person skilled in the art, attaching means allowing relative movement of an end section of a superheating tube with respect to a side wall only in a single, predefined direction, the direction of their relative thermal movement, can be achieved also by other designs than those shown in FIGS. 6*a* and 6*b*. For example, the designs of the wall part and the tube part can be switched. Thereby, the part comprising a metal plate with a slot can generally be called a first part, that can be connected either to an end section of a horizontally extending tube leg or to a side wall. Correspondingly, the part comprising a transverse piece attached by a rod to an end section of a horizontally extending tube leg or to a side wall, can generally be called a second part.

According to an alternative design, the first part of the attaching means comprises two vertically extending metal plates with oblong slots, as described above, and the second part comprises a strong, transverse metal pin attached by a rod to the side wall or to the end section of a horizontally extending tube. Also, it is possible that the first part of the attaching means comprises only one vertically extending metal plate with an oblong slot with a definite direction, and the second part comprises a transverse metal slab extending in the same direction as the slot or a strong, transverse metal pin, which slab or pin is arranged between two rods attached to the side wall or to the end section of a horizontally extending tube.

While the invention has been described herein by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

The invention claimed is:

1. An arrangement for horizontally supporting a first side wall of a top-supported vertical flue gas pass in a thermal power steam generator, wherein the first side wall comprises evaporative water tubes for conveying a mixture of water and steam at a first temperature, and the top-supported vertical flue gas pass comprises a superheating tube for conveying steam at a second temperature higher than the first temperature, the superheating tube comprising multiple rigid, horizontally extending tube legs extending across the top-supported vertical flue gas pass from the proximity of the first side wall to the proximity of a second side wall opposite to the first side wall in the top-supported vertical flue gas pass, wherein the superheating tube is supported from above by a hanger that is, in operation, at a third temperature higher than the first temperature, and the rigidity of the first side wall is increased by each of the rigid, horizontally extending tube legs comprising a first end section and a second end section, each of the first and second end sections being attached to a proximate side wall by an attaching means, wherein the attaching means allows relative movement between a respective end section and the proximate side wall only in a direction slanted from a vertical direction towards the first side wall in downward direction of relative thermal movement between the respective end section and the proximate side wall, but does not allow purely horizontal movement between the respective end section and the proximate side wall.

2. The arrangement for horizontally supporting a first side wall of a top-supported vertical flue gas pass according to claim 1, wherein the attaching means is arranged to provide a sliding connection between the first and second end sections and the proximate side wall.

3. The arrangement for horizontally supporting a first side wall of a top-supported vertical flue gas pass according to claim 1, wherein the second side wall is externally supported by supporting means, making the second side wall more rigid than the first side wall, and the tube legs of the superheating tube provide means for transferring horizontal loads from the first side wall to the second side wall.

4. The arrangement for horizontally supporting a first side wall of a top-supported vertical flue gas pass according to claim 1, wherein the first side wall is a common wall of the top-supported vertical flue gas pass and an adjacent flue gas pass upstream of the top-supported vertical flue gas pass.

5. The arrangement for horizontally supporting a first side wall of a top-supported vertical flue gas pass according to claim 1, wherein the first side wall is a common wall of the top-supported vertical flue gas pass and a furnace of the thermal power steam generator.

6. The arrangement for horizontally supporting a first side wall of a top-supported vertical flue gas pass according to claim 1, wherein the first side wall is a common wall of the top-supported vertical flue gas pass and an empty pass downstream of a furnace of the thermal power steam generator.

7. The arrangement for horizontally supporting a first side wall of a top-supported vertical flue gas pass according to claim 1, wherein the second side wall comprises evaporative water tubes for conveying a mixture of water and steam at the first temperature, and the tube legs of the superheating tube provide an in horizontal direction rigid structure within the top-supported flue gas pass for increasing the rigidity of both the first side wall and the second side wall.

8. The arrangement for horizontally supporting a first side wall of a top-supported vertical flue gas pass according to claim 7, wherein the top-supported vertical flue gas pass comprises a third side wall and a fourth side wall comprising evaporative water tubes for conveying a mixture of water and steam at the first temperature, the third side wall and the fourth side wall being located in between and perpendicular to the first side wall and the second side wall, wherein the superheating tube comprises multiple, rigid, horizontally extending tube legs extending across the top-supported vertical flue gas pass between the third side wall and the fourth side wall, and the superheating tube comprises a first end section attached to the third side wall and a second end section attached to the fourth side wall by attaching means that allows relative movement of each of the first and second end sections with respect to the side wall to which the end section is attached only in a direction of relative thermal movement between the end section and the side wall to which the end section is attached, so as to provide a rigid structure within the top-supported vertical flue gas pass for increasing the rigidity of the third side wall and the fourth side wall.

9. The arrangement for horizontally supporting a first side wall of a top-supported vertical flue gas pass according to claim 1, wherein the attaching means includes first and second attaching means, the first and second attaching means allowing relative movement only in the direction slanted from the vertical direction.

10. The arrangement for horizontally supporting a first side wall of a top-supported vertical flue gas pass according to claim 9, wherein the first and second attaching means comprise a first part attached to one of an end section of one of the horizontally extending tube legs and the side wall to which the end section is attached, wherein the first part comprises a vertically extending metal plate having an oblong slot, and a second part comprising a transverse piece attached by a rod to the other one of the end section of the one of the horizontally extending tube legs and the side wall to which the end section is attached, and is arranged to be movable in the slot.

11. The arrangement for horizontally supporting a first side wall of a top-supported vertical flue gas pass according to claim 10, wherein the first part comprises two vertically extending metal plates arranged side by side, each of the metal plates having an oblong slot, and the transverse piece comprises a transverse metal pin or a transverse metal slab extending in the same direction as those of the oblong slots.

12. The arrangement for horizontally supporting a first side wall of a top-supported vertical flue gas pass according to claim 1, wherein the attaching means includes first and second attaching means, one of the first and second attaching means allowing relative movement only in a vertical direction and the other one of the first and second attaching means allowing relative movement only in the direction slanted from the vertical direction.

13. A method of horizontally supporting a first side wall of a top-supported vertical flue gas pass in a thermal power steam generator comprising an arrangement for horizontally supporting the first side wall according to claim 1, the method comprising the steps of:

(a) providing a mixture of water and steam at a first temperature in evaporative water tubes of the first side wall;

(b) conveying steam at a second temperature higher than the first temperature in the superheating tube arranged within the top-supported vertical flue gas pass, the superheating tube comprising multiple, rigid, horizontally extending tube legs extending across the top-supported flue gas pass between the first side wall and the second side wall of the top-supported flue gas pass opposite to the first side wall;

(c) supporting the superheating tube from above by a hanger, which is at a third temperature, higher than the first temperature; and (d) increasing rigidity of the first side wall by horizontally supporting the first side wall by attaching the first end section and the second end section of each of the multiple, rigid, horizontally extending tube legs to the first side wall and to the second side wall, respectively, by an attaching means, wherein the attaching means is formed so as to allow relative movement of each of the first and second end sections with respect to the respective side wall to which the end section is attached, only in a direction of relative thermal movement slanted from the vertical direction towards the side wall in the downward direction between the end section and the side wall to which the end section is attached, but does not allow purely horizontal movements between the respective end section and the proximate side wall.

* * * * *